US005255608A

United States Patent [19]

Min et al.

[11] Patent Number: 5,255,608

[45] Date of Patent: Oct. 26, 1993

[54] REAL-TIME IDENTIFICATION OF A MEDIUM FOR A HIGH-SPEED PENETRATOR

[75] Inventors: Kwang S. Min; Hisook L. Min, both of Commerce, Tex.

[73] Assignee: The United States of America as represented by the Secretary of the Air Force, Washington, D.C.

[21] Appl. No.: 993,742

[22] Filed: Dec. 16, 1992

[51] Int. Cl.[5] ..... F42C 11/06

[52] U.S. Cl. ..... 102/215; 102/206; 102/266

[58] Field of Search ..... 102/215, 206, 266, 265, 102/270

[56] References Cited

U.S. PATENT DOCUMENTS

| | | | |
|---|---|---|---|
| 4,375,192 | 3/1983 | Yates et al. | 102/215 |
| 4,455,939 | 6/1984 | Munzel | 102/215 |
| 4,480,550 | 11/1984 | Abt | 102/215 |
| 4,580,498 | 4/1986 | Abt et al. | 102/215 |
| 4,667,598 | 5/1987 | Gröbler et al. | 102/215 |
| 4,694,752 | 9/1987 | Titus | 102/215 |
| 4,703,693 | 11/1987 | Spies et al. | 102/215 |
| 4,799,427 | 1/1989 | Held et al. | 102/215 |

*Primary Examiner*—David H. Brown

*Attorney, Agent, or Firm*—Bernard E. Franz; Donald J. Singer

[57] ABSTRACT

Intelligent hard-target weapons provide a real-time estimation of a medium as the weapon is penetrating through it. Input signals are provided by an accelerometer used as a primary sensor. On-line concurrent processing of the data of a specific length facilitates a few different modes of feature extraction. The processor provides a robust, real-time decision making for the fuze utilizing sensor signals (accelerometer data). The feature sets utilized include (1) amplitude profiles of the signals, (2) their derivative profiles, and (3), the measure of their abrupt changes. The purpose is to provide for detonation at the proper point as the high-speed penetrator passes through various layers such as concrete, steel, dirt, sand, etc. on its way to a valuable buried target. Real-time decision making is provided for the fuze utilizing accelerometer data.

4 Claims, 8 Drawing Sheets

Classification Using Four Feature Maps

Five Features Extracted for Medium Detection (Rule Based)

80789 . acc

| | | | | | | | | |
|---|---|---|---|---|---|---|---|---|
| 0=a1 | 1=a2 | 2=a3 | 70=c1 | 71=c2 | 72=c3 | 73=c4 | 74=c5 | 75=c6 |
| 40=s1 | 41=s2 | 42=s3 | 43=s4 | 50=ca1 | 51=ca2 | 52=ca3 | 53=ca4 | 54=ca5 |
| 60=cs1 | 61=cs2 | 62=cs3 | 20=noise | | | | | |

Detailed Medium Indentification (Rule Based) -- #1.

110890 . acc

| | | | | | | | | |
|---|---|---|---|---|---|---|---|---|
| 0=a1 | 1=a2 | 2=a3 | 70=c1 | 71=c2 | 72=c3 | 73=c4 | 74=c5 | 75=c6 |
| 40=s1 | 41=s2 | 42=s3 | 43=s4 | 50=ca1 | 51=ca2 | 52=ca3 | 53=ca4 | 54=ca5 |
| 60=cs1 | 61=cs2 | 62=cs3 | 20=noise | | | | | |

Detailed Medium Indentification (Rule Based) -- #2.

032891 . acc

| | | | | | | | | |
|---|---|---|---|---|---|---|---|---|
| 0=a1 | 1=a2 | 2=a3 | 70=c1 | 71=c2 | 72=c3 | 73=c4 | 74=c5 | 75=c6 |
| 40=s1 | 41=s2 | 42=s3 | 43=s4 | 50=ca1 | 51=ca2 | 52=ca3 | 53=ca4 | 54=ca5 |
| 60=cs1 | 61=cs2 | 62=cs3 | 20=noise | | | | | |

Detailed Medium Indentification (Rule Based) -- #3.

80789 . acc

DATA (COMPRESSED 1:5)

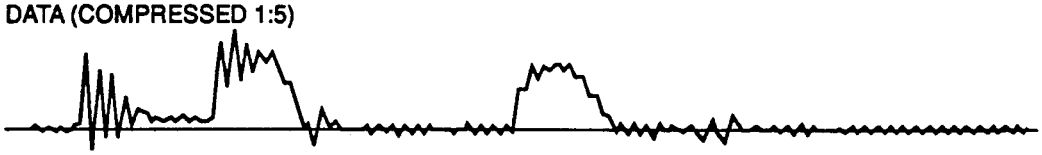

DETECTION RESULTS

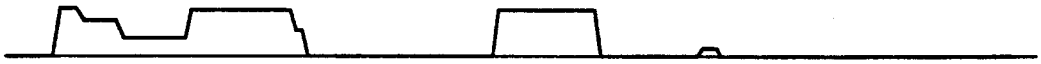

0000554442222225555555530000000000000005555555500000000100000000000000000000

*Fig. 6*

0 = air 1 = noise
2 = sand 3 = concrete to air
4 = concrete to sand 5 = concrete Medium Indentification (Rule Based) -- #1.

110890 . acc

DATA (COMPRESSED 1:5)

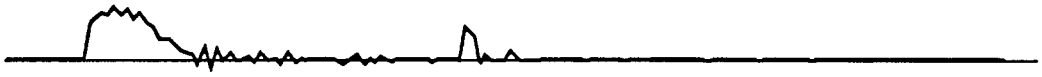

DETECTION RESULTS

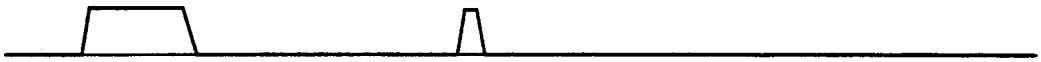

0000005555555500000000000000000000055000000000000000000000000000000000000000

*Fig. 7*

0 = air 1 = noise
2 = sand 3 = concrete to air
4 = concrete to sand 5 = concrete Medium Indentification (Rule Based) -- #2.

032891 . acc

DATA (COMPRESSED 1:5)

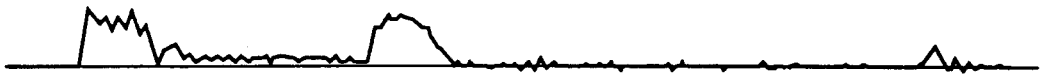

DETECTION RESULTS

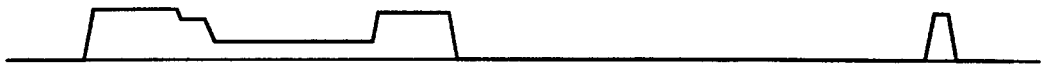

0000005555555442222222222222555555000000000000000000000000000000000000500000

*Fig. 8*

0 = air 1 = noise
2 = sand 3 = concrete to air
4 = concrete to sand 5 = concrete Medium Indentification (Rule Based) -- #3.

REAL-TIME IDENTIFICATION OF A MEDIUM FOR A HIGH-SPEED PENETRATOR

RIGHTS OF THE GOVERNMENT

The invention described herein may be manufactured and used by or for the Government of the United States for all governmental purposes without the payment of any royalty.

BACKGROUND OF THE INVENTION

The present invention relates generally to intelligent hard-target weapons, which depend on detonation taking place in a specified medium at a desired depth of the target.

The effectiveness of a penetrating weapon against hard targets is dependent on the detonation taking place in a specified medium at a desired depth of the target. These targets include high valued substances buried underground beneath several layers of concrete, steel, dirt, sand, etc.

It is essential for the fuze to have sufficient information on which medium the projectile is in to make an intelligent detonation decision. Sensors utilized for the penetrators are accelerometers to date.

The following U.S. patents are of interest.

4,375,192—Yates et al 4,455,939—Munzel 4,799,427—Held et al

Held et al discloses a projectile ignition device, wherein the ignition moment is controllable as a function of the impingement delay and of the flight time of the projectile. This allows compensation for the type of material comprising the target, e.g., hard or soft. The application is for penetrating into certain armor platings. The output signal 10 of the acceleration pickup sensor 1 (disposed in the projectile) activates the input of a threshold circuit 2. The output signal 10 may be either an output signal 11 or output signal 12 depending on the threshold value. Two embodiments are disclosed.

Yates et al discloses a programmable fuze for a weapon warhead which is designed to initiate detonation upon penetration of a target a preselected distance or after a preselected number of cavities. A triaxial accelerometer 10 measures the deceleration of the weapon as it enters a target. Zero slope detector 16 outputs a zero slope signal 161 which indicates that there is a discontinuity in density of the target material, i.e., a cavity in the target. Microcomputer 15 has an algorithm stored within a RAM and operates of the data field to determine if threshold values have been exceeded. Four fields of information are in a data word. Detonation depends on one of four possible conditions.

Munzel discloses an impact fuze with flight time-dependent detonation delay.

SUMMARY OF THE INVENTION

An objective of the invention is to provide a processor which may provide a robust, real-time decision making for the fuze utilizing sensor signals (accelerometer data).

The invention relates to a process for intelligent hard-target weapons, which provides a real-time estimation of the medium as the weapon is penetrating through it. Input signals are provided by an accelerometer used as a primary sensor. On-line concurrent processing of the data of a specific length facilitates a few different modes of feature extraction. The feature sets utilized include: (1) amplitude profiles of the signals, (2) their derivative profiles, and (3), the measure of their abrupt changes. The purpose is to provide for detonation at the proper point as the high-speed penetrator passes through various layers such as concrete, steel, dirt, sand, etc. on its way to a valuable buried target. Real-time decision making is provided for the fuze utilizing accelerometer data.

BRIEF DESCRIPTION OF THE DRAWING

FIG. 6 is a graph showing medium identification (rule Based)—#1;

FIG. 7 is a graph showing medium identification (rule Based)—#2;

FIG. 8 is a graph showing medium identification (rule Based)—#3;

DETAILED DESCRIPTION

Systematic efforts to develop a robust algorithm to make a good estimate of the medium the projectile is penetrating through has been initiated by the Fuzes Branch, Munitions Division, Wright Laboratory Armament Directorate, Laboratory of the Air Force, and many programs have been progressed to date.

Most of this work utilizes integration and double integration of the measured accelerometer signals to obtain information on the velocity and the penetration depth. This method requires knowledge of an impact velocity and also an angle of entry.

Limited efforts utilizing fixed frame size Fourier transform techniques to obtain frequency features of the medium, also took place in the past. Some studies incorporated penetration dynamics with simple models. These efforts are primarily non-real time analysis or experimentations with idealistic modeling.

As a real time detection of a hard target, some weapons in use (e.g. HTOP) utilize low-pass filtered analog accelerometer signal and threshold it to detect the entry to a hard medium. A recent experiment with thick concrete layers indicates that this algorithm becomes less sensitive to the second hard medium only if the first layer is sufficiently thick. Similar results are likely to happen with layers of steel plates and other thick and hard media with this current algorithm.

1. OVERVIEW

The approach adopted in the process according to the invention, deviates from most of the existing works, which rely on integration and double integration of accelerometer signals. Rather than taking accelerometer data as deterministic 'acceleration' values, we treat them as the fluctuating measure closely related to the pressure sensed by the penetrating projectile.

Figure 1:
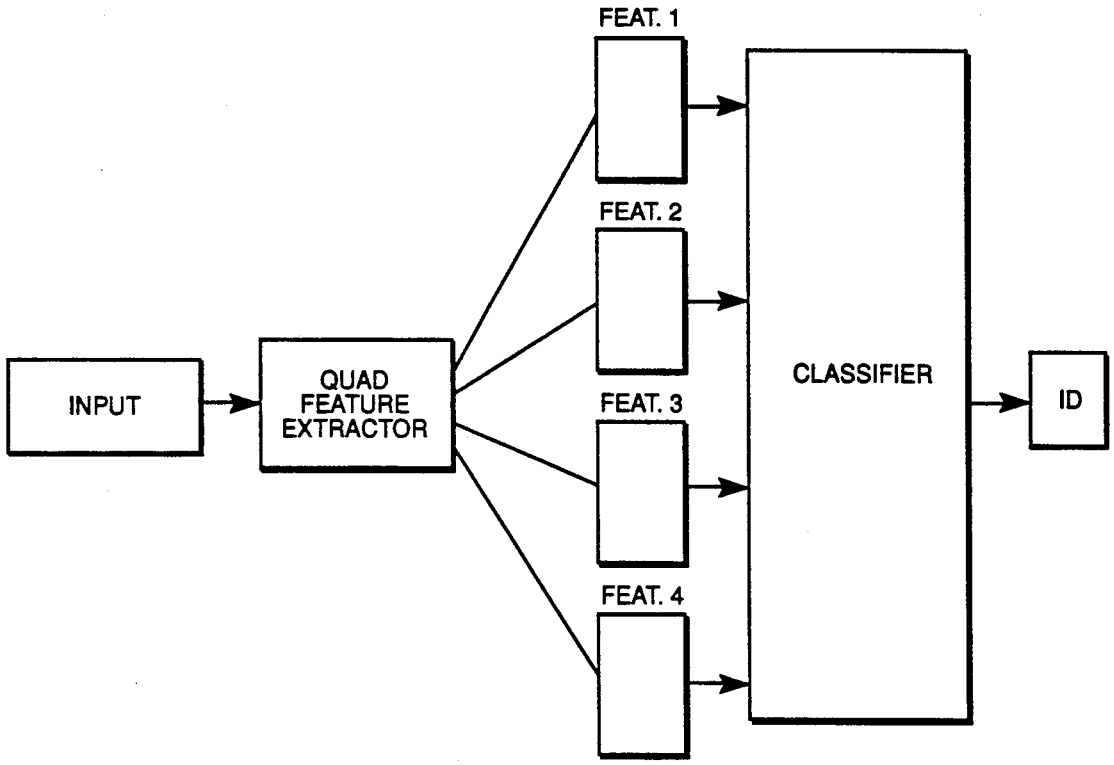
FIG. 1 is a symbolic diagram showing classification using four feature maps.

Therefore, instead of estimating the velocity and the penetration depth using measured accelerometer readings, features are extracted. These features change as a penetrator goes into a different medium This 'diagnostic' algorithm is illustrated in FIG. 1. Sensor signals are provided by an accelerometer acting as the primary sensor.

As FIG. 1 illustrates, a stream of data from a narrow window (specified number of data) is broadcasted to several feature extraction blocks. On-line concurrent processing at each block extracts a respective feature simultaneously.

The classifier process was based on the traditional classifier which uses rule based method. The following section describes the details of this method.

2. RULE BASED CLASSIFIER

2.1 Feature Extraction

In search of sensitive features which reflect the activity of the accelerometer signals, experiments have been performed for many features with the real data sets. These features include auto-correlation measures and short-time Fourier transforms. However, they did not prove to be sensitive enough to contribute to fast decision making required for real-time medium identification.

Five features have been selected in the following categories: (1) the intensity of signals, (2) the magnitude of their derivatives and (3) the measure of sudden changes. All of these features are taken from a narrow window whose size is optimized (250 microseconds) in such a way that it does not loose a fine time resolution yet it contains enough data to extract statistical characteristics from them. Optimization of this window size is very important.

Feature 1 and Feature 2 are derived from the first category, Feature 3 and Feature 4 from the second, and Feature 5 from the third category. The details of these features are described below.

The index i denotes the window number, and j is the data number in the window. N is the total number of data, and ws is the window size. A typical value of ws is 50. N/ws depends on the test condition and may run up to a large number. Let S[j] denote the amplitude of a j-th data point and ZG the zero-g value. The signal intensity w[i] will be defined as $$W[i] = \sum_{j=0}^{ws-1} |S[ws*i + j] - ZG|/ws \quad \text{for } i = 0, 1, 2, \ldots, N/ws \tag{2-1}$$

F1[i], Feature 1 of the i-th window, is the average of W[i], W[i−1], W[i−2] and W[i−3] as defined below.

$$F1[i] = \sum_{j=0}^{3} W[i - j]/4.0 \quad \text{for } i = 3, 4, 5, \ldots, N/ws \tag{2-2}$$

F2[i], Feature 2 of the i-th window, is the two window average of W[i] and W[i-1] of Eq. 2−1:

$$F2[i] = \sum_{j=0}^{1} W[i - j]/2.0 \tag{2-3}$$

-continued $$\text{for } i = 1, 2, 3, \ldots, N/ws$$

Thus Feature 1 gives a broader view of the intensity of signals, while Feature 2 represents a more localized view of the signal intensity.

Let A[i] denote the average of the absolute values of the first order derivatives of S[i] as shown below.

$$A[i] = \sum_{j=0}^{ws} |S[ws*i + j] - S[ws*i + j - 1]|/ws \quad \text{for } i = 0, 1, 2, \ldots, N/ws \tag{2-4}$$

Feature 3 of the i-th window, F3[i], is $$F3[i] = \sum_{j=0}^{3} A[i - j] \quad \text{for } i = 3, 4, 5, \ldots, N/ws \tag{2-5}$$

$$\text{Let } D[i] = \sum_{j=0}^{ws} |S[ws*i + j] - S[ws*i + j - 1]|/ws \quad \text{for } i = 0, 1, 2, \ldots, N/ws \tag{2-6}$$

Feature 4 of the i-th window, F4[i], is $$F4[i] = \sum_{j=0}^{3} |D[i - j] - D[i - j - 1]|/4.0 \quad \text{for } i = 4, 5, 6, \ldots, N/ws \tag{2-7}$$

Thus Features 3 and 4 are the sensitivity measures which represent the degrees of variation. While Feature 3 measures the variation of the amplitude between consecutive data points, Feature 4 measures the change of the variation between consecutive windows.

Define Feature 5 of the i-th window, F4[i], as $$F5[i] = \sum_{j=0}^{3} (F[i - j] - F1[i - j - 1]) \quad \text{for } i = 4, 5, 6, \ldots, N/ws \tag{2-8}$$

Feature 5 gives a 'bird's-eye view' of abrupt changes in signal intensity.

Figure 2:
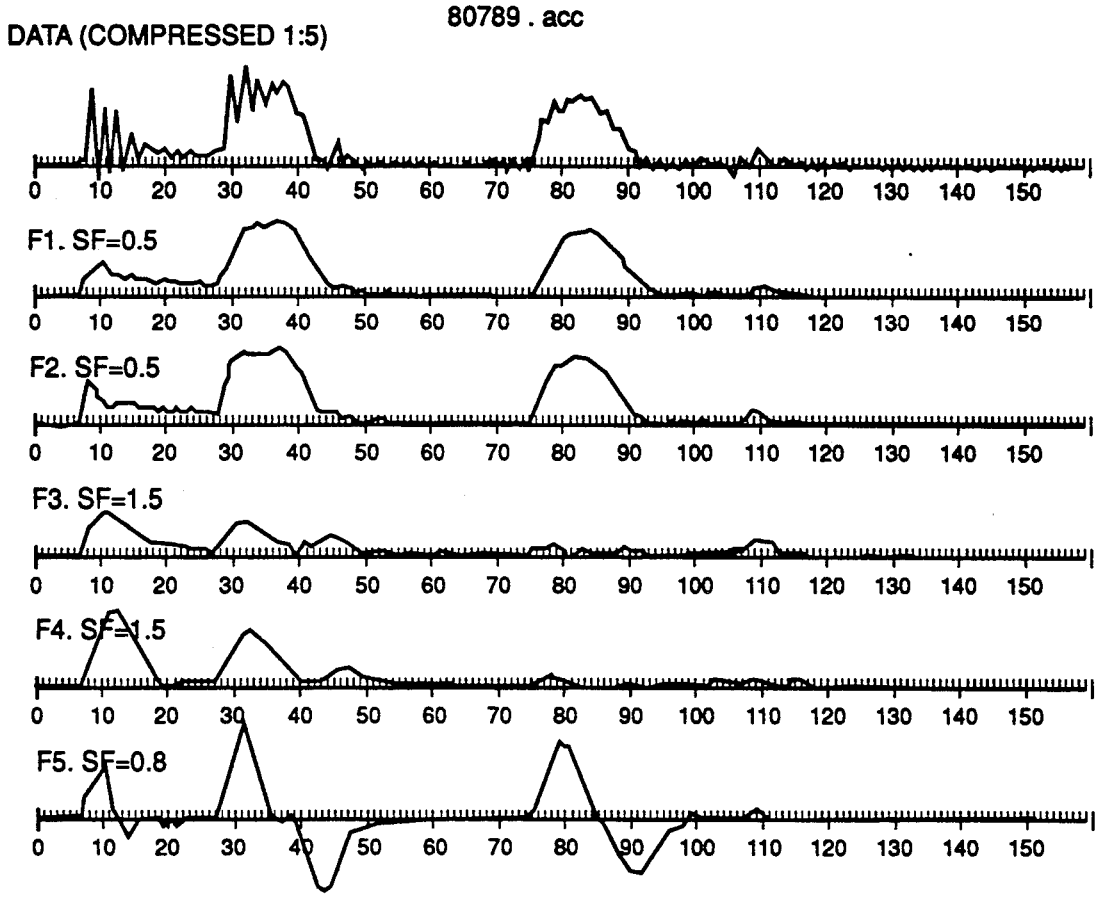
FIG. 2 is a graph showing five features extracted for medium detection (rule based)

A combination of the features described above characterizes each medium appropriately. FIG. 2 illustrates how these features react as the penetrator moves from one medium to another.

As the figure shows, in order to make a judgment on the degree of the activeness of a feature in a medium, a proper threshold value has to be set to the feature with respect to the medium. This will be discussed in the following section.

2.2 Threshold Setting

Figure 3:
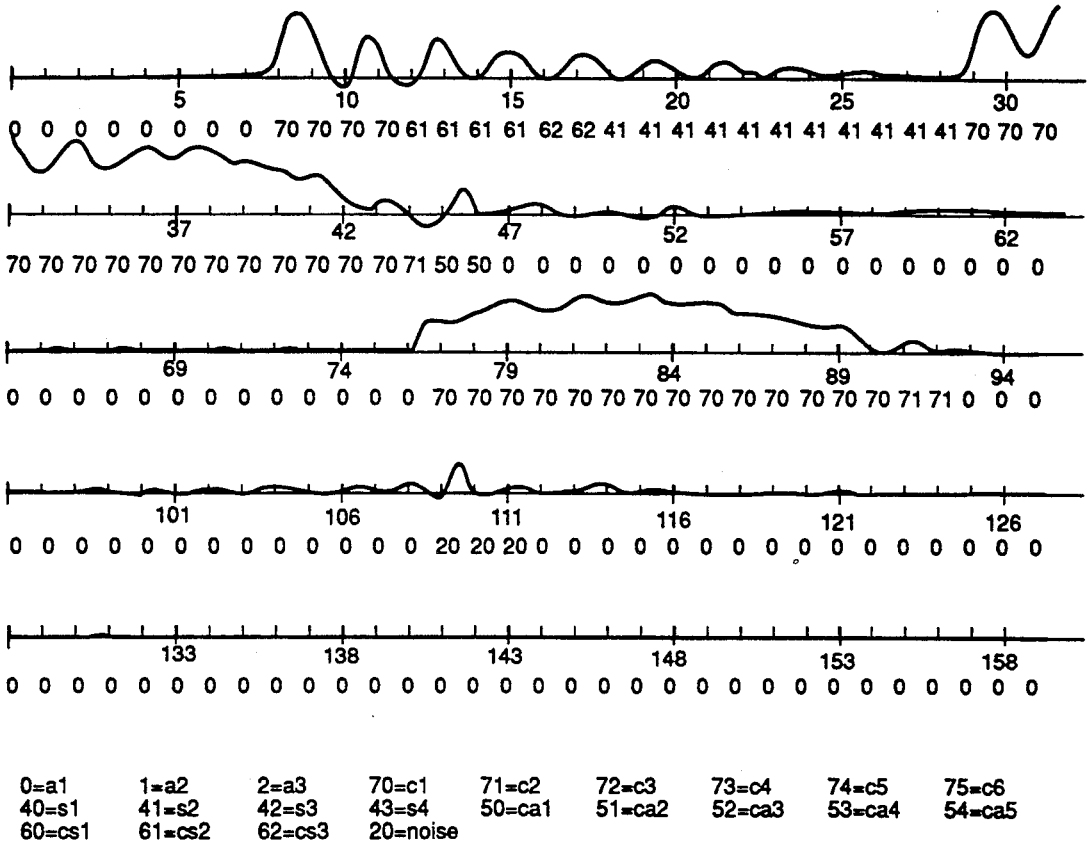
FIG. 3 is a graph showing detailed medium identification (rule Based)—#1.
Figure 4:
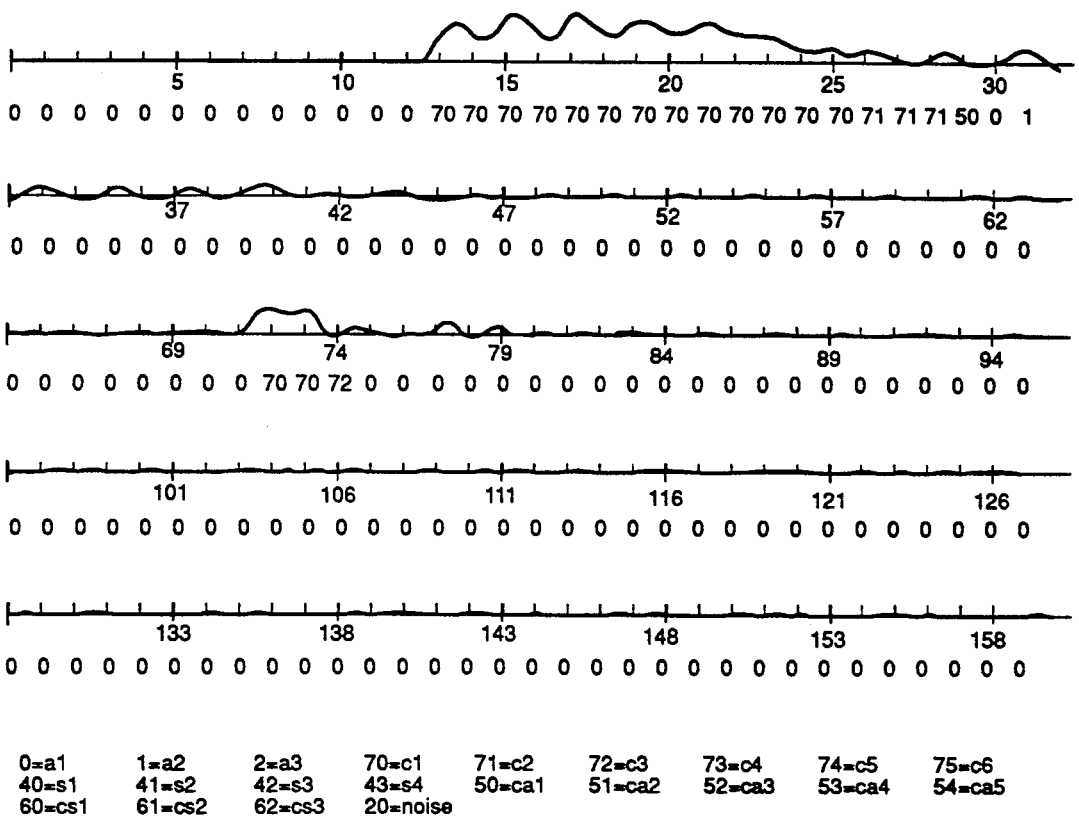
FIG. 4 is a graph showing detailed medium identification (rule Based)—#2.
Figure 5:
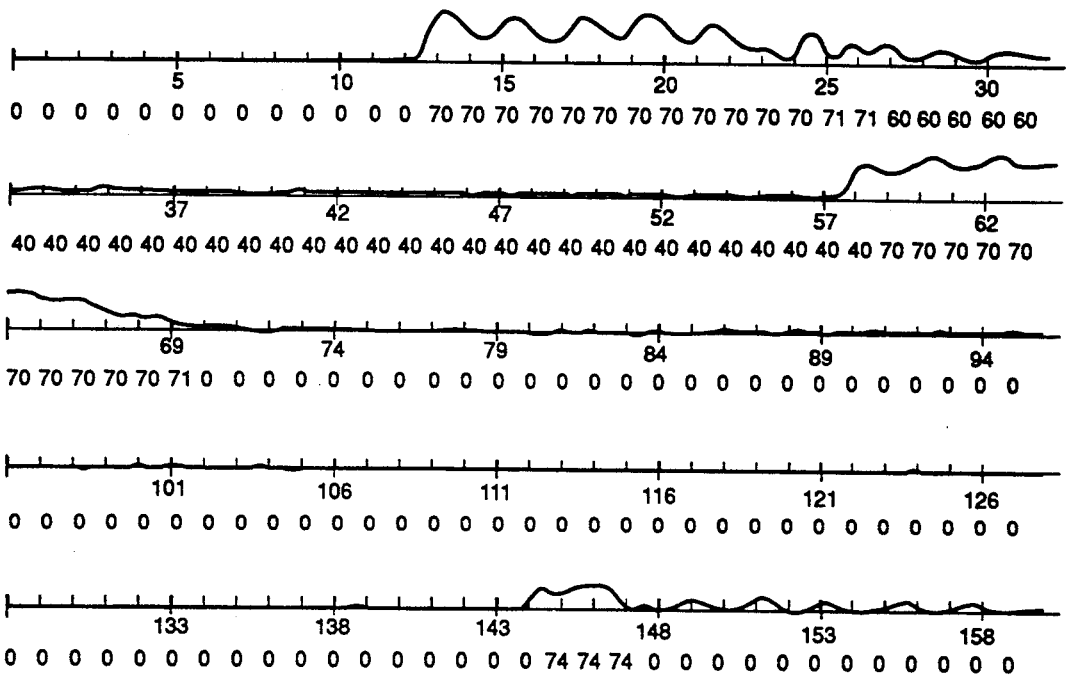
FIG. 5 is a graph showing detailed medium identification (rule Based)—#3.

The data sets analyzed in this work provide three different media—air, sand and concrete. For convenience, however, before setting the threshold values for the extracted features each medium was divided into several subsets. The concrete was divided into six subsets (C1, C2, C3, C4, C5 and C6), the sand into four subsets (S1, S2, S3 and S4) and the air into three subsets (A1, A2 and A3). Further the transitional portion from the concrete to the air is divided into five subsets (CA1, CA2, CA3, CA4 and CA5), and that from the concrete to the sand is divided into three subsets (CS1, CS2 and CS3). The data sets also had some noise spikes. Therefore noise is included as a separate class. FIGS. 3–5 illustrate how these subsets are related to the signal waveforms captured in each window.

The features mentioned in Sec 2.1 are thresholded to fit each of these subsets. However, the number of features used for each classification vary. For example, C1 uses two features while S1 needs four features. In order to minimize the processing time, a minimum number of features are selected in such a way that these features with their proper threshold values are capable of exclusively setting aside a particular class from all other classes. The following is the thresholding mechanism used for the rule-based classification in this work.

| | | |
|---|---|---|
| A1: | F1 < 6.5 or F2 < 6.5 | |
| A2: | 7.1 < (both F1 and F2) < 8.5 | and 3.6 < F4 < 4.2 |
| A3: | 6.5 < (both F1 and F2) < 9.75 and −4.4 < F5 < −1.6 | and 8.0 < F4 < 12.1 |
| C1: | F1 > 23.0 or F2 > 23.0 | |
| C2: | (F1 > 15.0 or F2 > 15.0) | and F5 < −20.0 |
| C3: | (F1 > 18.5 or F2 > 18.5) and 12.6 < F5 < 16.7 | and 6.7 < F4 < 16.2 |
| C4: | 6.8 < (both F1 and F2) < 14.9 and 4.5 < F5 < 10.3 | and 1.8 < F3 < 3.9 |
| C5: | 10.0 < (both F1 and F2) < 20.8 and 9.7 < F5 < 15.7 | and 1.8 < F3 < 3.4 |
| C6: | 8.2 < (both F1 and F2) < 22.0 and 7.9 < F5 < 9.7 | and 2.5 < F3 < 5.7 |
| S1: | 6.8 < (both F1 and F2) < 12.0 and 0.0 < F4 < 2.8 | and 0.0 < F3 < 3.2 and −6.2 < F5 < 1.6 |
| S2: | 8.5 < (both F1 and F2) < 18.5 and 1.7 < F4 < 7.3 | and 1.1 < F3 < 5.6 and −5.9 < F5 < 0.4 |
| S3: | 10.5 < (both F1 and F2) < 12.5 | and 0.5 < F5 < 1.9 |
| S4: | 9.1 < (both F1 and F2) < 22.9 and 0.3 < F4 < 4.5 | and 7.1 < F3 < 9.7 and 9.1 < F5 < 17.7 |
| CA1: | 8.0 < (both F1 and F2) < 14.5 and −45.0 < F5 < −6.5 | and 1.5 < F4 < 14.6 |
| CA2: | 11.7 < (both F1 and F2) < 19.8 and −18.7 < F5 < −6.8 | and 3.1 < F4 < 4.2 |
| CA3: | 16.8 < (both F1 and F2) < 20.0 and 5.6 < F5 < 6.2 | and 11.9 < F4 < 12.5 |
| CA4: | 9.75 < (both F1 and F2) < 17.2 and 2.4 < F4 < 8.80 | and 6.0 < F3 < 9.8 and −8.2 < F5 < −2.5 |
| CA5: | 6.5 < (both F1 < F2) < 9.9 and 0.8 < F5 < 2.4 | and 4.0 < F4 < 4.8 |
| CS1: | 8.2 < (both F1 and F2) < 18.4 and −13.4 < F5 < −7.3 | and 0.6 < F4 < 1.5 |
| CS2: | 16.4 < (both F1 and F2) < 22.9 and −13.2 < F5 < 6.9 | and 20.6 < F4 < 26.7 |
| CS3: | 17.3 < (both F1 and F2) < 19.8 and −3.4 < F5 < −2.6 | and 11.7 < F4 < 17.4 |
| noise: | 6.5 < (both F1 and F2) < 15.2 and 5.5 < F5 < 7.3 | and 6.0 < F3 < 7.1 |

FIGS. 3–5 illustrate a few examples of the results of the real-time identification of a medium with these subsets, and FIGS. 6–8 the results of broader classifications. As the figures show, the classifier provides a perfect identification for all of the seven Motorola fuze data sets.

SYSTEM HARDWARE

Figure 9:
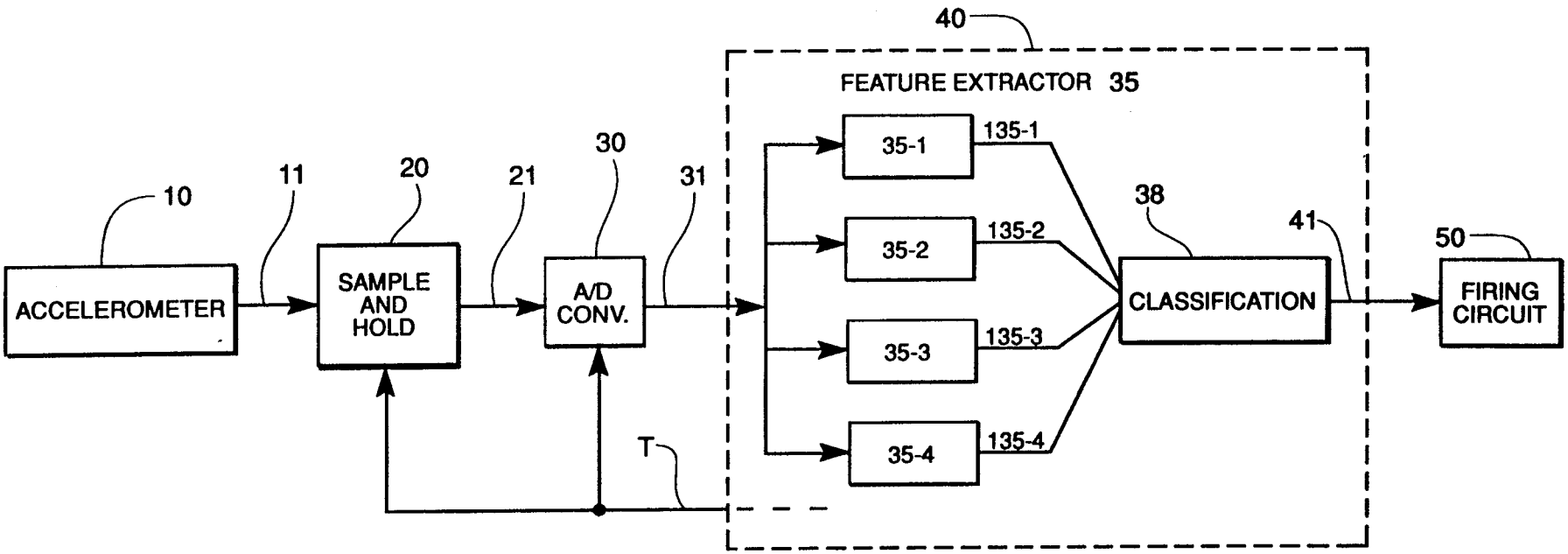
FIG. 9 is a hardware block diagram of the system for real-time identification of a medium for a high-speed penetrator.

A block diagram of the system hardware is shown in FIG. 9. It includes an accelerometer 10 which supplies analog signals on line 11. A sample and hold circuit 20 samples the signal at intervals determined by a timing signal on a line T. An A/D converter 30 converts the signals to digital form, and supplies them via line 31 to a feature extractor block 35 (a quad unit comprising blocks 35-1, 35-2, 35-3 and 35-4). Feature extractions are done in parallel in this block 35, and the results are fed into a classifier 38. Based on this classification, a output signal is supplied via line 41 to a firing circuit 50 to detonate the projectile. The feature extractor 35 and classifier 38 are part of a processor block 40.

The data are in analog form, and the sampling rate ranges from 1 sample per 50-microsecond to 1 sample per microsecond interval. By way of example, if a window has a duration of 250 microseconds, and the sampling interval is 5 microseconds, then the window size would be a number ws=50. A miniature size parallel computer (processor block 40) was used, which can perform on-line concurrent processing. The size of this unit is smaller than a soup can, and it can perform a few hundred MIPS of operations (SPPD program at Eglin Air Force Base, Florida).

FLOW CHART OF OPERATION

Figure 10:
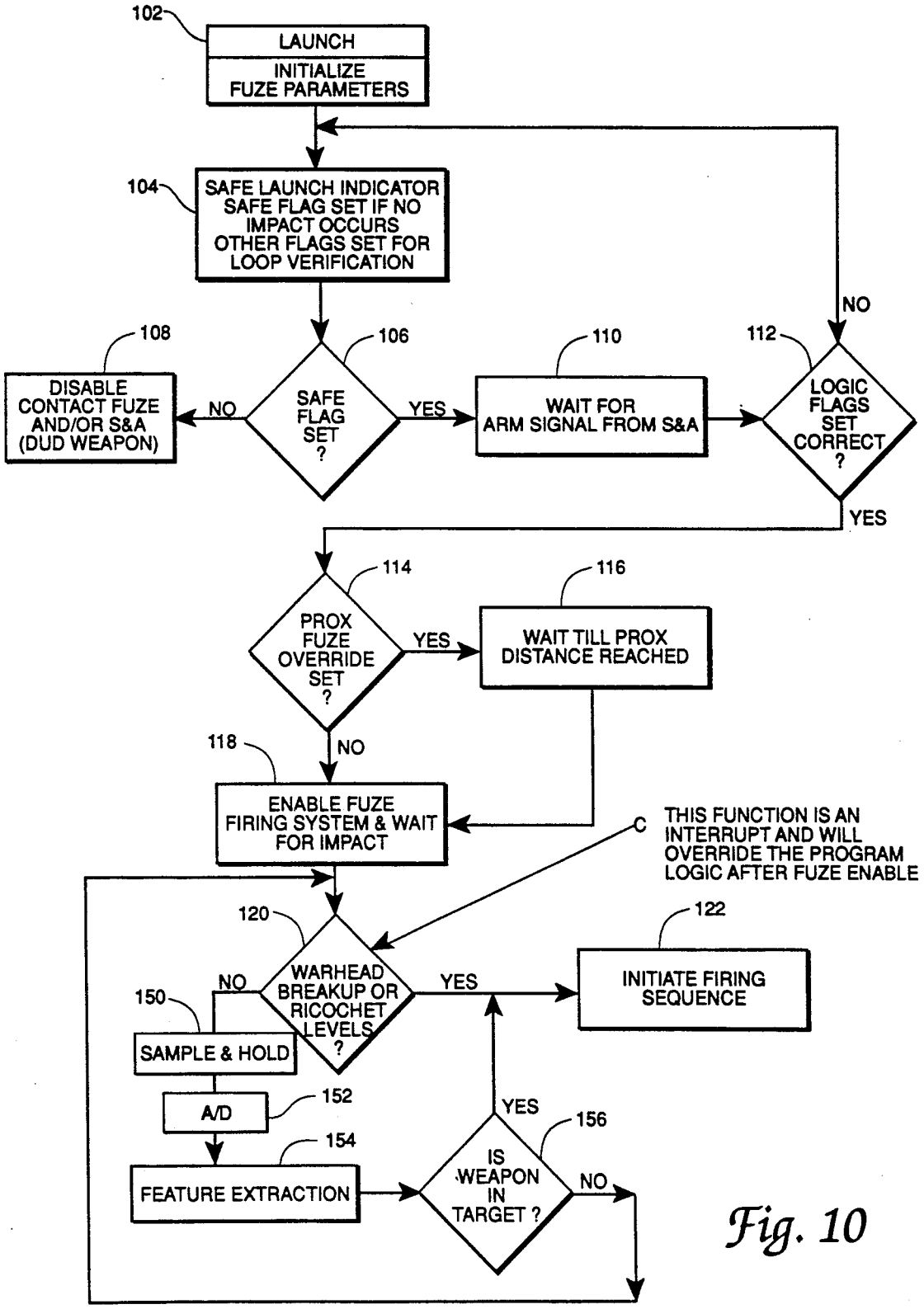
FIG. 10 is a flow chart showing the method of operation of the system of FIG. 1.

FIG. 10 is a flow chart showing operation of the system. Data are sampled and held (block 150) to form and appropriate window size and converted to digital form (block 152). This data are broadcast to the four feature extraction blocks (block 154). Extracted data are fed in the classifier (block 156) to make a decision as to whether the weapon is in target, and if yes the system produces an output signal to detonate the missile. If the classification decision at block 156 is no, the operation continues via a block 120 to go to block 150 to sample more data.

The operation blocks 102–122 of FIG. 10 represent prior fuze logic as shown in the flow chart of Yates et al Pat. No. 4,375,192. Upon launch of the weapon, fuze parameters are initialized at block 102. To prevent hazards from dud weapons, a safe launch indicator at block 104 sets a flag if no impacts occur within a predetermined time after the launch signal. If the flag is not set, the fuze is disabled and/or the safing and arming circuit fails to arm the firing system. If the safe flag is set, the arming sequence continues in a normal manner. After a given interval of time and a given sequence of events, the safing and arming circuit outputs an arming signal. Logic flags are further verified at block 112 and if properly set, the proximity fuze override is checked at block 114. If the proximity fuze override is set, the weapon must reach a given range from the target before the fuze is enabled. This prevents detonation from enemy round hits that might appear as a true target to the logic. Otherwise the fuze is enabled directly. Block 120 shown as a decision block for warhead breakup or ricochet levels represents an interrupt function and will override the program logic after fuze enable.

ADVANTAGES NEW FEATURES

Without requiring any knowledge of the impact velocity of a penetrator or the angle of attack, a real-time identification of a medium embedding the penetrator is achieved using narrowly windowed data.

The process identifies not only thick concrete walls, but also thin concrete walls (six inches or one foot). Other media, such as sand or mud can be identified, including noise spikes. It is also capable of distinguishing whether the penetrator is exiting from a concrete wall to sand (or mud) or to air. Previously, there is no process which identifies these media.

The process is sensitive and is not hampered by any of the preceding process. For example, it is capable of detecting a subsequent entry of the penetrator to the next hard medium right after the penetration of a hard thick layer.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A programmable fuze for an intelligent hard-target weapon, which provides a real-time estimation of each of a plurality of media as the weapon is penetrating through it, for initiating a warhead detonation, comprising:

an accelerometer used as a primary sensor which provides analog input signals;

processing means including a feature extractor and a classifier, the classifier having a firing signal output;

means coupled between the accelerometer and the feature extractor for sampling the analog input signals at a given interval and converting them to a stream of data in digital form;

wherein the feature extractor comprises a plurality of extraction units in parallel, means for dividing the stream of data into windows of a given number (ws) of data, and means for broadcasting the data to the extraction units in parallel, wherein each extraction unit includes means for extracting a respective feature selected from categories comprising: (1) intensity of signals, (2) a magnitude of their derivatives, and (3) a measure of sudden changes, with the extraction units operating simultaneously;

wherein the classifier includes rule based means based on the features from the feature extractor for classifying the medium, and decision means based on the classification for determining if the weapon is in target, and if so for supplying a signal at the firing signal output to initiate warhead detonation.

2. A programmable fuze according to claim 1, wherein there are five of said features, designated feature 1, feature 2, feature 3, feature 4 and feature 5, with feature 1 and feature 2 derived from said first category, feature 3 and feature 4 from the second category, and feature 5 from the third category, the details of these features being as follows:

let S[j] denote the amplitude of a j-th data point and ZG the zero-g value, with the signal intensity w[i] defined as $$W[i] = \sum_{j=0}^{ws-1} |S[ws*i + j] - ZG|/ws \quad \text{(2-1)}$$

$$\text{for } i = 0, 1, 2, \ldots, N/ws$$

wherein the index i denotes the window number, and j is the data number in the window, N is the total number of data, and ws is the window size;

F1[i], feature 1 of the i-th window, is the average of W[i], W[i−1], W[i−2] and W[i−3] as defined below, $$F1[i] = \sum_{j=0}^{3} W[i - j]/4.0 \quad \text{(2-2)}$$

$$\text{for } i = 3, 4, 5, \ldots, N/ws$$

F2[i], feature 2 of the i-th window, is the two window average of W[i] and W[i−1] of Eq. 2−1:

$$F2[i] = \sum_{j=0}^{1} W[i - j]/2.0 \quad \text{(2-3)}$$

$$\text{for } i = 1, 2, 3, \ldots, N/ws$$

thus feature 1 gives a broader view of the intensity of signals, while Feature 2 represents a more localized view of the signal intensity;

let A[i] denote the average of the absolute values of the first order derivatives of S[i] as shown below, $$A[i] = \sum_{j=0}^{ws} |S[ws*i + j] - S[ws*i + j - 1]|/ws \quad \text{(2-4)}$$

$$\text{for } i = 0, 1, 2, \ldots, N/ws$$

feature 3 of the i-th window, F3[i], is $$F3[i] = \sum_{j=0}^{3} A[i - j] \quad \text{(2-5)}$$

$$\text{for } i = 3, 4, 5, \ldots, N/ws$$

$$\text{Let } D[i] = \sum_{j=0}^{ws} |S[ws*i + j] - S[ws*i + j - 1]|/ws \quad \text{(2-6)}$$

$$\text{for } i = 0, 1, 2, \ldots, N/ws$$

feature 4 of the i-th window, F4[i], is $$F4[i] = \sum_{j=0}^{3} |D[i - j] - D[i - j - 1]|/4.0 \quad \text{(2-7)}$$

$$\text{for } i = 4, 5, 6, \ldots, N/ws$$

thus features 3 and 4 are the sensitivity measures which represent the degrees of variation, while feature 3 measures the variation of the amplitude between consecutive data points, feature 4 measures the change of the variation between consecutive windows;

define feature 5 of the i-th window, F4[i], as $$F5[i] = \sum_{j=0}^{3} (F[i - j] - F1[i - j - 1]) \quad \text{(2-8)}$$

$$\text{for } i = 4, 5, 6, \ldots, N/ws$$

feature 5 gives a 'bird's-eye view' of abrupt changes in signal intensity;

wherein the classifier uses a combination of said features to characterize each medium appropriately.

3. A programmable fuze according to claim 2, wherein the media comprise at least a first, a second and a third medium, wherein in the classifier in order to make a judgment on the degree of the activeness of a feature in a medium, a proper threshold value is set to the feature with respect to the medium;

wherein each medium is divided into a plurality of subsets, and wherein a transitional portion from the first medium to the second medium is divided into a plurality of subsets, and that from the second medium to the third medium is divided into a plurality of subsets;

wherein said features are thresholded to fit each of these subsets, with the number of features used for each classification varying, wherein to minimize the processing time, a minimum number of features are used in such a way that these features with their proper threshold values are capable of exclusively setting aside a particular class from all other classes.

4. A programmable fuze according to claim 2, wherein the media comprise concrete, sand and air, and wherein in the classifier in order to make a judgment on the degree of the activeness of a feature in a medium, a proper threshold value is set to the feature with respect to the medium;

wherein each medium is divided into a plurality of subsets, the concrete being divided into six subsets (C1, C2, C3, C4, C5 and C6), the sand into four subsets (S1, S2, S3 and S4) and the air into three subsets (A1, A2 and A3); and wherein a transitional portion from the concrete to the air is divided into five subsets (CA1, CA2, CA3, CA4 and CA5), and that from the concrete to the sand is divided into three subsets (CS1, CS2 and CS3); and wherein noise is included as a separate class;

wherein said features are thresholded to fit each of these subsets, with the number of features used for each classification varying, wherein to minimize the processing time, a minimum number of features are used in such a way that these features with their proper threshold values are capable of exclusively setting aside a particular class from all other classes.

* * * * *